United States Patent [19]

Sanditen

[11] Patent Number: 5,031,915

[45] Date of Patent: Jul. 16, 1991

[54] APPARATUS FOR RANDOMLY SELECTING NUMBERS FROM A PREDETERMINED SET

[76] Inventor: Thomas B. Sanditen, 102 Vista Dr., Danville, Calif. 94526

[21] Appl. No.: 519,781

[22] Filed: May 7, 1990

[51] Int. Cl.[5] ..... A63F 9/04

[52] U.S. Cl. ..... 273/146

[58] Field of Search ..... 273/146, 138 R, 139, 273/147

[56] References Cited

U.S. PATENT DOCUMENTS

| | | | |
|---|---|---|---|
| 1,492,368 | 4/1924 | Funai | 273/146 X |
| 1,525,023 | 2/1925 | Brown | 273/146 |
| 1,787,521 | 1/1931 | Harrington, Jr. | 273/146 X |
| 1,986,710 | 1/1935 | Brown | 273/146 |
| 2,238,079 | 4/1941 | Scheib | 273/146 X |
| 3,195,895 | 7/1965 | Kropinski | 273/146 X |
| 3,208,754 | 9/1965 | Sieve | 273/146 |
| 3,899,838 | 8/1975 | Lalley et al. | 273/146 X |
| 4,106,774 | 8/1978 | Seguin | 273/146 |
| 4,497,487 | 2/1985 | Crippen | 273/146 |
| 4,720,108 | 1/1988 | Gramera | 273/146 |

*Primary Examiner*—William H. Grieb

*Attorney, Agent, or Firm*—Schapp and Hatch

[57] ABSTRACT

Apparatus for randomly selecting numbers from a predetermined set consisting of two elongated dies, each in the form of a heptagonal right prism.

Each face of the first elongated die is colored with a color different from the color of all of the other faces. Each elongated face of the second die is subdivided into seven segments, each segment being colored with the color of one of the faces of the first die. Each segment of the second die bears a representation of one of the decimal numbers from 1 to 49, inclusive.

3 Claims, 2 Drawing Sheets

24

| | A | B | C | D | E | F | G |
|---|---|---|---|---|---|---|---|
| a | R 1 | O 8 | Y 15 | G 22 | B 29 | I 36 | V 43 |
| b | V 2 | R 9 | O 16 | Y 23 | G 30 | B 37 | I 44 |
| c | I 3 | V 10 | R 17 | O 24 | Y 31 | G 38 | B 45 |
| d | B 4 | I 11 | V 18 | R 25 | O 32 | Y 39 | G 46 |
| e | G 5 | B 12 | I 19 | V 26 | R 33 | O 40 | Y 47 |
| f | Y 6 | G 13 | B 20 | I 27 | V 34 | R 41 | O 48 |
| g | O 7 | Y 14 | G 21 | B 28 | I 35 | V 42 | R 49 |

FIG. 5

APPARATUS FOR RANDOMLY SELECTING NUMBERS FROM A PREDETERMINED SET

BACKGROUND OF THE INVENTION

1. Field of the Invention

My invention relates to random number selection apparatus, and more particularly to apparatus for randomly selecting individual numbers from a predetermined set of numbers.

2. Description of the Prior Art

Apparatuses for randomly selecting individual numbers from a predetermined set of numbers are well known in the prior art. Such apparatuses are used, for example, in connection with board games, or for making number selections to be played in state lotteries.

For example, U.S. Pat. No. 4,497,487, issued to Henry O. Crippen on Feb. 5, 1985, shows and describes a chance device which is comprised of two icosahedronal dice or casting bodies, one icosahedronal die having numbers thereon representing ten (10) odd numbers and ten (10) even numbers, from one to forty, and the other icosahedronal die having numbers thereon representing the remaining twenty numbers, from one to forty. This patent teaches that the dice or casting bodies disclosed therein are to be used in the playing of the New York State Lottery game, called "Lotto", in which six numbers from one to forty are selected by random, sequential drawing of air-mixed numbered balls, the object of the game being to match as many of the thus randomly selected numbers as possible.

As a further example, U.S. Pat. No. 3,208,754, issued to F. F. S. Sieve on Sept. 28, 1965, shows and describes a dice game comprising a plurality of dice, each die of this plurality being configured as one of the Platonic solids. In the game of this patent the number of solids may vary from two to any desired number, but it is preferred not to use more than four solids in addition to the tetrahedron, for Other centrosymmetrical or substantially centrosymmetrical dice or casting bodies are shown and described in the following United States patents.

| U.S. Pat. No. | Inventor |
|---|---|
| 1,492,368 | J. Funai |
| 1,525,023 | A. Brown |
| 1,986,710 | C. Brown |
| 3,195,895 | J. Kropinski |
| 3,899,838 | J. Lalley et al. |
| 4,106,774 | G. Seguin |

It is to be understood that the term "prior art" as used herein or in any statement made by or on behalf of applicant means only that any document or thing referred to as prior art bears, directly or inferentially, a date which is earlier than the effective filing date hereof.

No representation or admission is made that any of the above-listed patents is part of the prior art, or that a search has been made, or that no more pertinent information exists.

While centrosymmetrical or substantially centrosymmetrical dice or casting bodies, such as the dice of the Crippen patent, provide compact and inexpensive apparatus for use in randomly selecting numbers from a predetermined set, they are characterized by certain disadvantages.

First, it is difficult to fabricate centrosymmetrical dice having a large plurality of faces to a sufficient degree of geometrical accuracy to assure that there is no statistical bias in favor of rolling one or several faces more frequently than other faces of the same die.

Secondly, it becomes difficult, as the number of faces increases, to rapidly and accurately determine which face is the selected, i.e., topmost face of a resting die, and therefore the selected face, especially when the particular die is dodecahedronal or icosahedronal.

Thirdly, certain centrosymmetrical dice of lesser numbers of faces, and in particular the tetrahedron, are found by some users to be awkward to cast.

Additionally, the faces of dodecahedronal and icosahedronal dice of sufficiently small mean radius to be convenient for carrying in the pocket, i.e., of the general size of common cubical dioe, are so small that the numbers imprinted thereupon are difficult for some users to read, especially in low illumination.

SUMMARY OF THE INVENTION

Accordingly, it is an object of my invention to provide aparatus for randomly selecting individual numbers from a predetermined set of numbers, which apparatus enables the user to randomly select one number from said set in a single cast without adding or otherwise combining numbers.

It is another object of my invention to provide apparatus for use in randomly selecting one number from the set of integers from one to forty-nine, inclusive, in a single cast, without adding or otherwise combining numbers.

It is yet another object of my invention to provide a set of two dice for use in randomly selecting individual numbers from a set of numbers having as many as forty-nine members or more, the numbers on which dice are large enough to be easily read even though the dice of the set are so compact as to be easily carried in the pocket.

A yet further object of my invention is to provide a set of two dice for randomly selecting individual numbers from a predetermined set of as many as forty-nine members or more, the angular relationship between the faces of each die of this set being such that the selected faces, i.e., the faces to be heeded or regarded as governing the current number selection, are easily recognized as such when the dice are at rest upon a suitable flat surface.

It is an additional object of my invention to provide a set of dice for randomly selecting individual numbers from a predetermined set of numbers in which the count of numbers in the set is several times as great as the number of faces of either die.

It is a yet further object of my invention to provide methods and apparatus for enhancing the prospects of anticipating numbers to be drawn in lottery games.

It is a yet further object of my invention to provide methods and apparatus for selecting numbers anticipated to be drawn in a lottery game, whereby a player's individual deliberation is avoided and dependence upon the player himself or herself is reduced.

Other objects of my invention will in part be obvious and will in part appear hereinafter.

My invention, accordingly, comprises the several steps and the relation of one or more of such steps with respect to each of the others, and the apparatus embodying features of construction, combinations of elements, and arrangements of parts which are adapted to effect such steps, all as exemplified in the following disclosure, and the scope of my invention will be indicated in the appended claims.

In accordance with a principal feature of my invention apparatus for randomly selecting individual numbers from a predetermined set of numbers comprises a first elongated die having a plurality of elongated faces which are symmetrically disposed about a common axis, each of said faces being of a color different from the color of all of the other faces.

In accordance with another principal feature of my invention apparatus for randomly selecting individual numbers from a predetermined set of numbers further comprises a second elongated die having a plurality of elongated faces which are symmetrically disposed about a common axis, the number of faces of said second die being equal to the number of the faces of said first die, each face of said second die being divided into a number of segments equal to the number of faces of said first die, one segment of each face of said second die being colored to match one of the faces of said first die, and each segment of said second die bearing a representation of one number of said set which is not represented on any other one of said segments.

In accordance with yet another principal feature of my invention all of the faces of said first elongated die are substantially congruent.

In accordance with an additional principal feature of my invention, all of the faces of said second elongated die are substantially congruent.

In accordance with a yet further principal feature of my invention apparatus for randomly selecting individual numbers from the set of integers from one to forty-nine, inclusive, is comprised of two dies, each die being of the form of a regular heptagonal prism.

Another principal feature of my invention is the method of randomly selecting numbers by casting two dice, one of said dice having colored faces which determine the number selected from the other die.

For a fuller understanding of the nature and objects of my invention, reference should be had to the following detailed description, taken in connection with the accompanying drawing.

BRIEF DESCRIPTION OF THE DRAWINGS

FIG. 5 is a chart representing the color of each face segment of the selector die of the first preferred embodiment of my invention and the number represented on each face segment.

DESCRIPTION OF THE PREFERRED EMBODIMENTS

Figure 1:
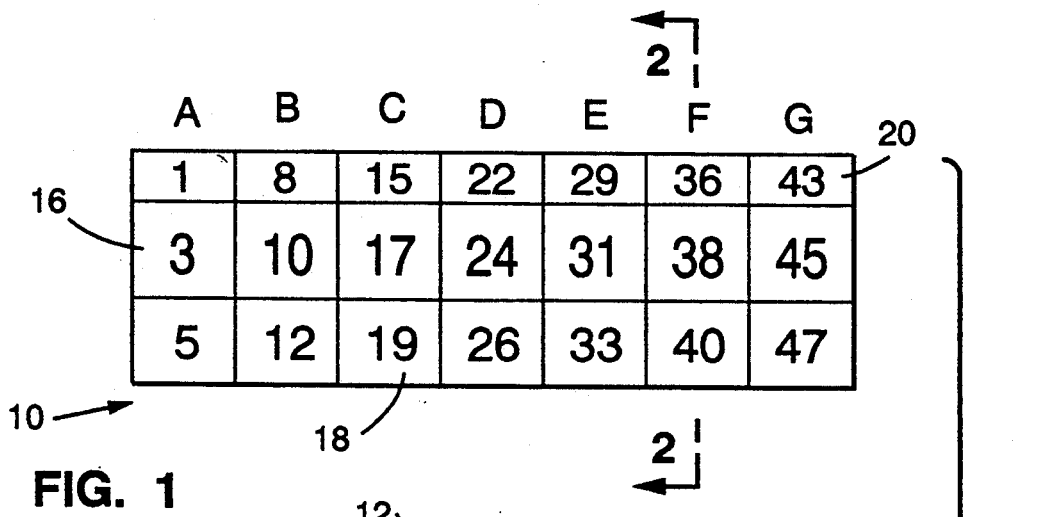
FIG. 1 is an elevational view of a die of the first kind, or selector die, constructed in accordance with the preferred embodiment of my invention.
Figure 2:
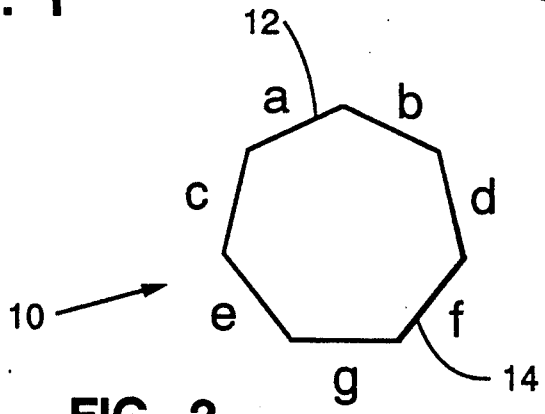
FIG. 2 is a cross-sectional view in elevation of the selector die shown in FIG. 1, taken on plane 2—2 of FIG. 1.

Referring now to FIGS. 1 and 2, there is shown the selector die 10 of the first preferred embodiment of my invention.

As may be seen by comparison of FIGS. 1 and 2, selector die 10 is a solid of the form of a heptagonal right prism.

As seen in FIG. 2, the seven elongated lateral sides or faces of selector die 10 are designated, respectively, by the lower case letters a through 9. Thus, elongated side or face 12 of selector die 10 is designated by the lower case letter a, lateral side or face 14 is designated by the lower case letter f, etc.

Referring now to FIG. 1, it will be seen that each elongated side or face of selector die 10 is subdivided into seven segments.

For example, elongated face c is subdivided into seven segments bearing, respectively, the numerals 3, 10, 17, 24, 31, 38, and 45. Similarly, elongated face e is subdivided into seven segments bearing, respectively, the numerals 5, 12, 19, 26, 33, 40, and 47.

As will now be evident to those having ordinary skill in the art, informed by the present disclosure, the outer surface of selector die 10 is subdivided into forty-nine segments each bearing a representation of a decimal number. Thus, for example, segment 16 bears a representation of the numeral 3, segment 18 bears a representation of the decimal, number 19, and segment 20 bears a representation of the decimal number 43.

In accordance with the principles of my invention, each segment is colored with one of the primary colors, red, orange, yellow, green, blue, indigo, and violet.

Each face has but one segment colored with one of the seven primary colors.

For convenience in understanding the distribution of the decimal number representations and the segment colors over the outer surface of selection die 10, each of the segments is indicated by a combination of one capital letter and one lower case letter. The letter combination designating each sector can be determined by one having ordinary skill in the art by comparison of FIGS. 1 and 2. Thus, it will be understood that the segment designated by the reference numeral 16 is alternatively designated by the letter combination Ac. Similarly, it will be seen that segment 18 will also be designated by the letter combination Ce, and that segment 20 will alternatively be designated by the letter combination Ga.

Referring now to FIG. 5, it will be seen that the chart thereof indicates the color of each segment of selection die 10 and the decimal number which is represented on that segment.

For clarity, each of the seven primary colors is indicated in FIG. 5 by the initial letter of its name. Thus, R stands for red, 0 stands for orange, Y stands for yellow, G stands for green, B stands for blue, I stands for indigo, and V stands for violet.

Referring, then, to FIG. 5, it will be seen that segment 16 or Ac of selection die 10 is colored indigo and bears a representation of the decimal number 3.

Further, it will be seen from the chart of FIG. 5 that segment 18 or Ce is also colored indigo, and bears a representation of the decimal number 19.

Also, it will be seen from the chart of FIG. 5 that segment 20 or Ga is colored violet, and bears a representation of the decimal number 43.

Figure 3:
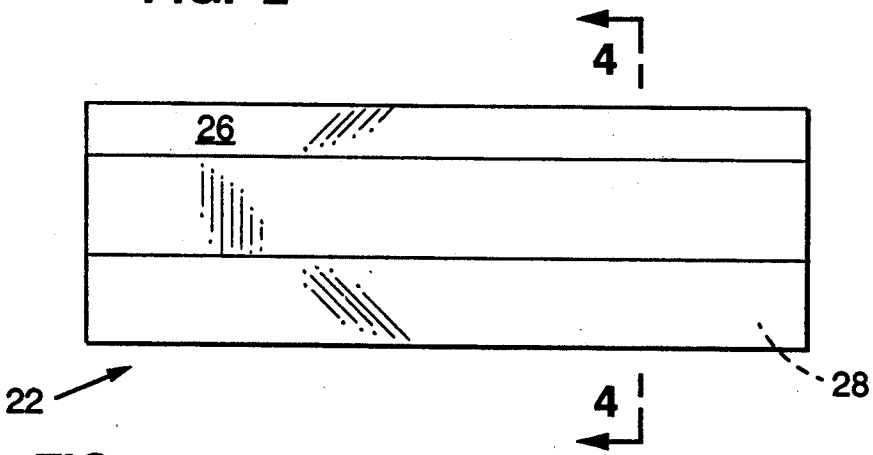
FIG. 3 is an elevational view of a die of the second kind, or indicator die, constructed in accordance with the first preferred embodiment of my invention.
Figure 4:
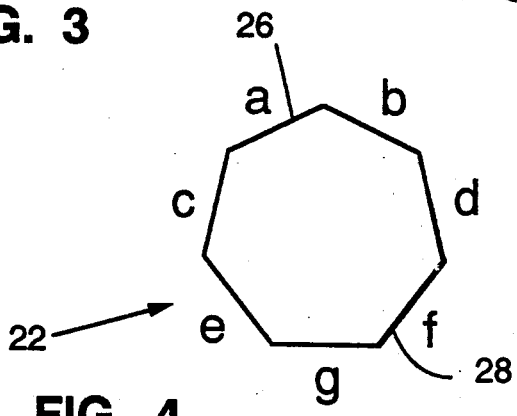
FIG. 4 is a sectional view in elevation of the indicator die shown in FIG. 3, taken on plane 4—4 of FIG. 3.

Referring now to FIGS. 3 and 4, there is shown the indicator die 22 of the first preferred embodiment of my invention.

It will be understood, then, that a die set 24 of the first preferred embodiment of my invention consists of a selector die 10 as described hereinabove in connection with FIGS. 1 and 2 and an indicator die 22 as shown in FIGS. 3 and 4, and described hereinbelow.

As seen in FIG. 3, indicator die 22 of the first preferred embodiment of my invention is of the same shape and size as selector die 10.

As may be seen by comparison of FIGS. 3 and 4, the faces of indicator die 22 are designated, respectively, by the lower case letters a through g. Thus, face 26 is designated by the lower case letter a, and face 28 is designated by the lower case letter f, etc.

In accordance with the principles of my invention, the respective faces a through g of indicator die 22 are each colored with one of the primary colors. Thus, face a is colored with the primary color red, face b is colored with the primary color orange, face c is colored with the primary color yellow, face d is colored with the primary color green, face e is colored with the primary color blue, face f is colored with the primary color indigo, and face 9 is colored with the primary color violet.

It is to be understood that the dice of my invention may be fabricated from any suitable material, such as a thermosetting plastic, and that the colors and decimal numbers may be applied to the respective dies 10, 22 by adhering thereto suitably printed sheet of wear-resistent material. The sheet applied to die 10 is subdivided into segments of the same shape and size as the segments of the die body, those respective segments of the sheet being colored and numbered in the manner indicated in the chart of FIG. 5.

In accordance with the method of my invention, then, a die set such as the die set of the first preferred embodiment is manually cast upon a suitable flat surface, and the user then observes the color of the upper face of the indicator die 22 which slopes toward him. This color will be called herein the "indicated color".

The user then observes the upper face of the resting selector die 10 which slopes toward him, and reads from that face the decimal number appearing on the segment of that face which is of the indicated color.

Thus, in a single cast of dies 10 and 22, the user instantly, randomly selects one number from the predetermined set of numbers 1 through 49, inclusive. Thus, for example, if at a particular cast the user observes indicator die 22 as shown in FIG. 3, the user will see that the indicated color is red.

If, further, the selector die 10 is disposed toward the user as seen in FIG. 1, the user will immediately see that the selected decimal number represented on the corresponding segment of the upper face sloping toward him, i.e., face a, in the indicated color segment, or red segment, is the numeral 1.

In accordance with the rules of certain state lotteries, which provide that no number pair may be immediately repeated in the same lottery entry, any such repetition, when rolled, may be replaced by any other number of the predetermined set, or the dice of my invention may be rerolled until a result different from the result of the previous roll is obtained.

It will thus be seen that the objects set forth above, among those made apparent from the preceding description, are efficiently attained, and since certain changes may be made in the above constructions and the method carried out thereby without departing from the scope of my invention, it is intended that all matter contained in the above description or shown in the accompanying drawings will be interpreted as illustrative only, and not in a limiting sense.

It is to be understood that my invention is in no sense limited to the first preferred embodiment shown in the instant drawings. For example, my invention also embraces die sets in which the mean diameter of the indicator die is less than the mean diameter of the selector die, i.e., in which the width of any elongated face of the indicator die is less than the width of any elongated face of the selector die.

Further, it is to be understood that the distribution of segment colors over the surface of the selector die is not limited to the particular distribution indicated in FIG. 5, and that the distribution of decimal numbers over the outer surface of the indicator die is not limited to the particular distribution shown in FIG. 5.

Thus, in accordance with a second preferred embodiment of my invention the segment numbers and colors on selector die 10 may be so redistributed that the segment numbers and colors formerly on face g appear on face c, the segment numbers and colors formerly on face f appear on face e, the segment numbers and colors formerly on face e appear on face g, the segment numbers and colors formerly on face d appear on face f, and the segment numbers and colors formerly on face c appear on face d.

Correspondingly, the segment colors on indicator die 22 may be redistributed in such manner that, reading around the die, they appear in the usual spectral order, i.e., red, orange, yellow, green, blue, indigo, and violet.

It is further to be understood that in some embodiments of my invention a sharp edge will not be found between adjacent elongated faces of the dies, but rather that these edges may be rounded.

It is also to be understood that the end faces of these dies may be imprinted with a suitable legend, such as applicant's trademark LOTTO LOG.

It is also to be understood that the following claims are intended to cover all of the generic and specific features of my invention hereindescribed, and all statements of the scope of my invention which, as a matter of language, might be said to fall therebetween.

What is claimed is:

1. Apparatus for randomly selecting numbers from a predetermined set, comprising:

a first elongated die having a plurality of elongated faces which are symmetrically disposed about a common axis, each of said faces being of a color different from the color of all of the other faces; and a second elongated die having a plurality of elongated faces which are symmetrically disposed about a common axis, the number of faces of said second die being equal to the number of faces of said first die, each face of said second die being divided into a number of segments equal to the number of faces of said first die, one segment of each face of said second die being colored to match one of the faces of said first die, and each segment of said second die bearing a representation of one number of said set which is not represented on any other one of said segments.

2. Apparatus as claimed in claim 1 in which all of the elongated faces of each die are substantially congruent to each other.

3. Apparatus as claimed in claim 1 in which each die is of the form of a regular heptagonal prism, and said set consists of the integers from one to forty-nine, inclusive.

* * * * *